US008435131B1

(12) United States Patent
Carter

(10) Patent No.: US 8,435,131 B1
(45) Date of Patent: May 7, 2013

(54) PORTABLE PUTTING PRACTICE SYSTEM

(76) Inventor: Leslie Carter, Felton, DE (US)

( * ) Notice: Subject to any disclaimer, the term of this patent is extended or adjusted under 35 U.S.C. 154(b) by 0 days.

(21) Appl. No.: 13/467,965

(22) Filed: May 9, 2012

(51) Int. Cl.
*A63B 69/36* (2006.01)

(52) U.S. Cl.
USPC ..... 473/265; 473/218

(58) Field of Classification Search ..... 473/218, 473/219, 257, 261, 262, 264, 265, 266, 268, 473/270, 278
See application file for complete search history.

(56) References Cited

U.S. PATENT DOCUMENTS

| | | | | |
|---|---|---|---|---|
| 3,899,180 | A | 8/1975 | Rodman | |
| 4,544,160 | A | 10/1985 | Miner | |
| 4,620,708 | A * | 11/1986 | Meyer et al. | 473/265 |
| 5,246,233 | A | 9/1993 | Sheltman et al. | |
| 5,437,458 | A | 8/1995 | Springer | |
| 5,582,407 | A * | 12/1996 | Sorenson | 473/256 |
| 5,785,604 | A | 7/1998 | Johnson | |
| 5,984,801 | A * | 11/1999 | Mason | 473/270 |
| 6,929,561 | B2 * | 8/2005 | Chang | 473/257 |
| D520,096 | S | 5/2006 | Prestwich | |
| 7,037,210 | B2 * | 5/2006 | Bainter | 473/270 |
| 7,418,674 | B2 * | 8/2008 | Robbins | 715/848 |
| 7,597,632 | B2 * | 10/2009 | Edwards et al. | 473/265 |
| 2005/0096146 | A1 * | 5/2005 | Burley | 473/270 |
| 2005/0261076 | A1 | 11/2005 | Palmer | |

* cited by examiner

*Primary Examiner* — Nini Legesse

(57) ABSTRACT

A portable putting practice system for users of all ages and skill levels, whereby the system enables a user to increase putting accuracy, improve range of motion for a putting swing, and develop consistent putting backswings of varying extensions corresponding to desired target distances.

15 Claims, 3 Drawing Sheets

(In-use View)

(Top ISO View)

(Bottom ISO View)

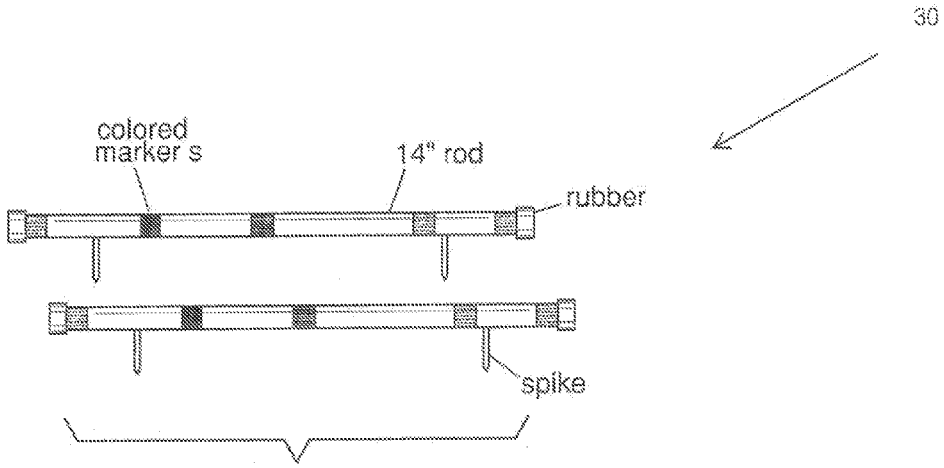
FIG. 3
(Side View)
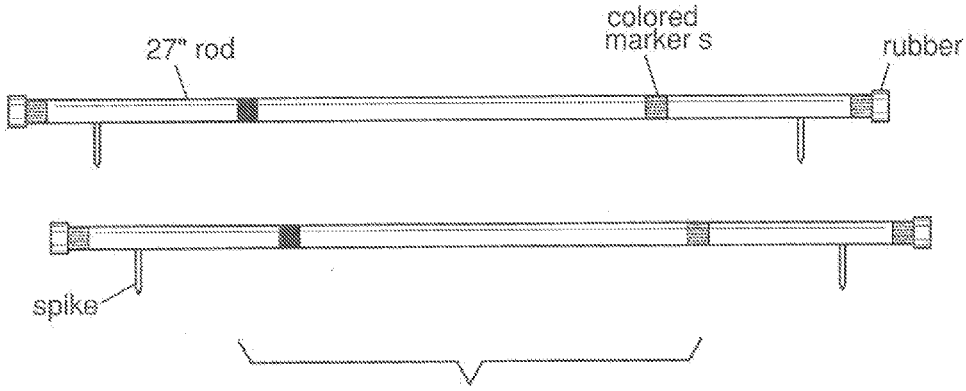
FIG. 4
(Side View)
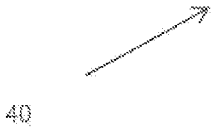

(In-use View)

PORTABLE PUTTING PRACTICE SYSTEM

BACKGROUND OF THE INVENTION

It is no secret that putting is one of the fundamental components of golf and requires numerous hours in order for one to achieve even basic putting capability. For this reason, it is not uncommon for golfers of all skill levels to devote a considerable amount of time to improving the putting game. As the prior art indicates, a number of inventions have been developed that attempt to assist golfers with putting practice. However, the prior art is cumbersome. The prior art requires multiple parts and requires time-consuming assembly and disassembly in order for a user to interact with the prior art apparatuses and systems for training.

As such, there is a need for a basic putting practice system; one that is both portable and easy to assemble and disassemble, while still incorporating novel features that can greatly improve putting ability.

SUMMARY

In some embodiments, the present invention features a basic portable system for putting practice wherein a user manually places two separate and unconnected elongate rods in a parallel formation on a putting surface.

Each rod can comprise a series of corresponding colored markers where one of said colored markers identifies the placement of a golf ball. The user can train to use the appropriate amount of backswing by limiting backswing according to the distance between the golf ball and one of said colored markers.

In some embodiments, the present invention comprises two elongate rods with a plurality of optional components for training a user to putt accurately with respect to both range and accuracy.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE DRAWINGS

FIG. 3 is a side view of one embodiment of the present invention where the primary [14] and complementary [15] elongate rods each comprise 14 inches in length [30].

FIG. 4 is a side view of another embodiment of the present invention where the primary [14] and complementary [15] elongate rods each comprise 27 inches in length [40].

DESCRIPTION OF PREFERRED EMBODIMENTS

Figure 1:
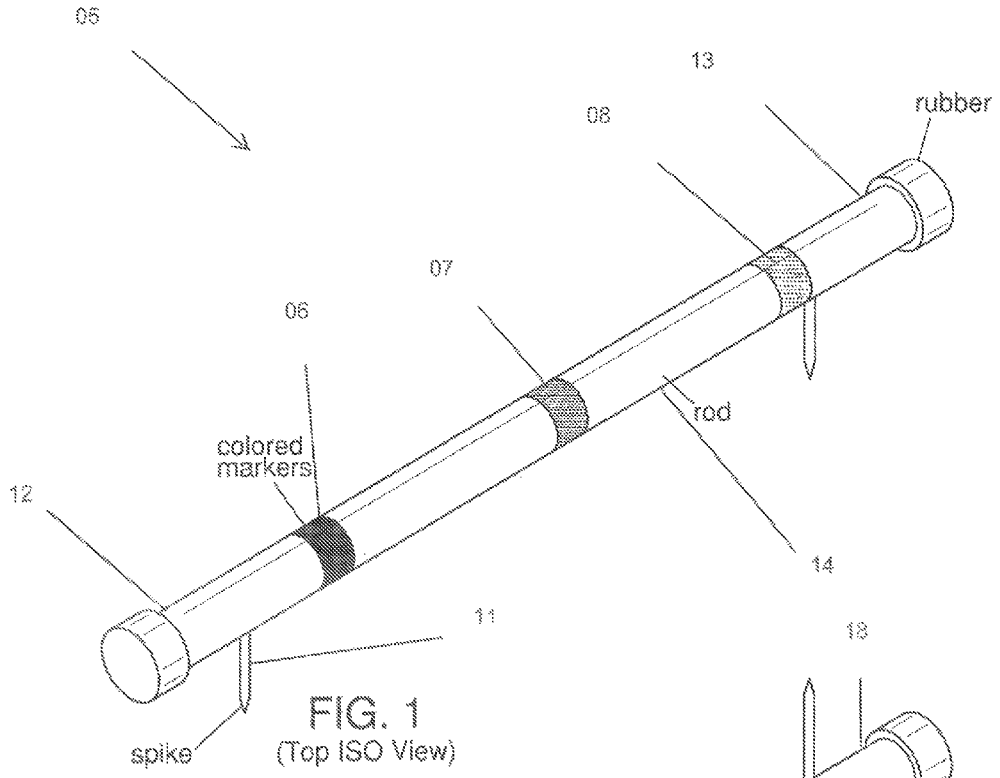
FIG. 1 is a top isometric ("ISO") view of the primary elongate rod [14] of the present invention [5].
Figure 2:
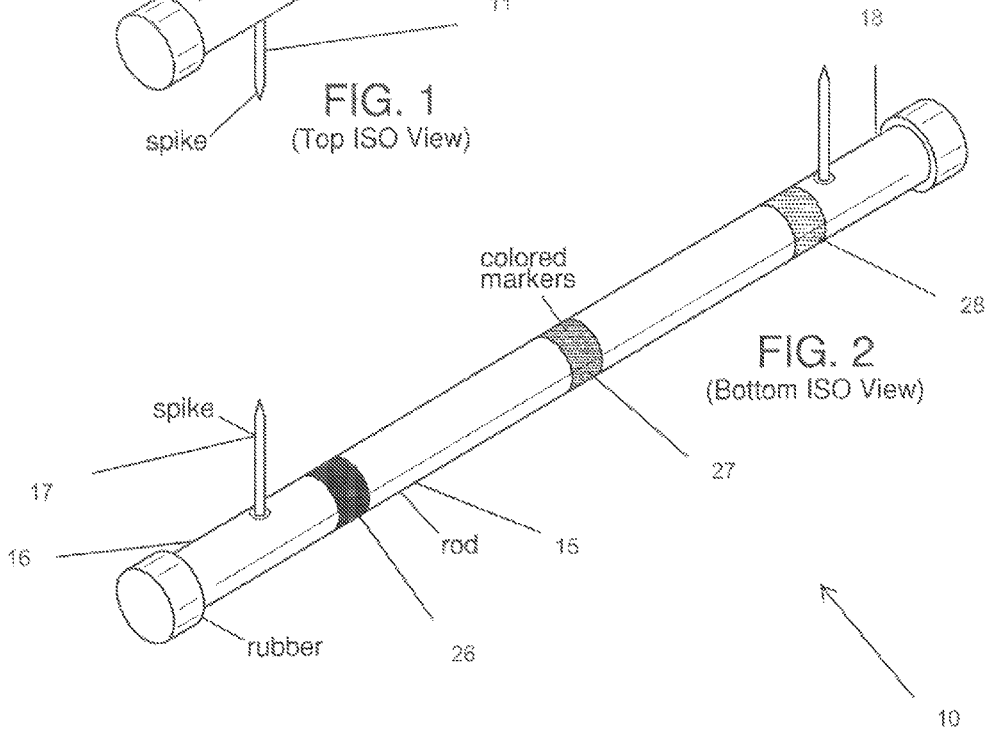
FIG. 2 is a bottom ISO view of the complementary [15] elongate rod of the present invention [10].
Figure 5:
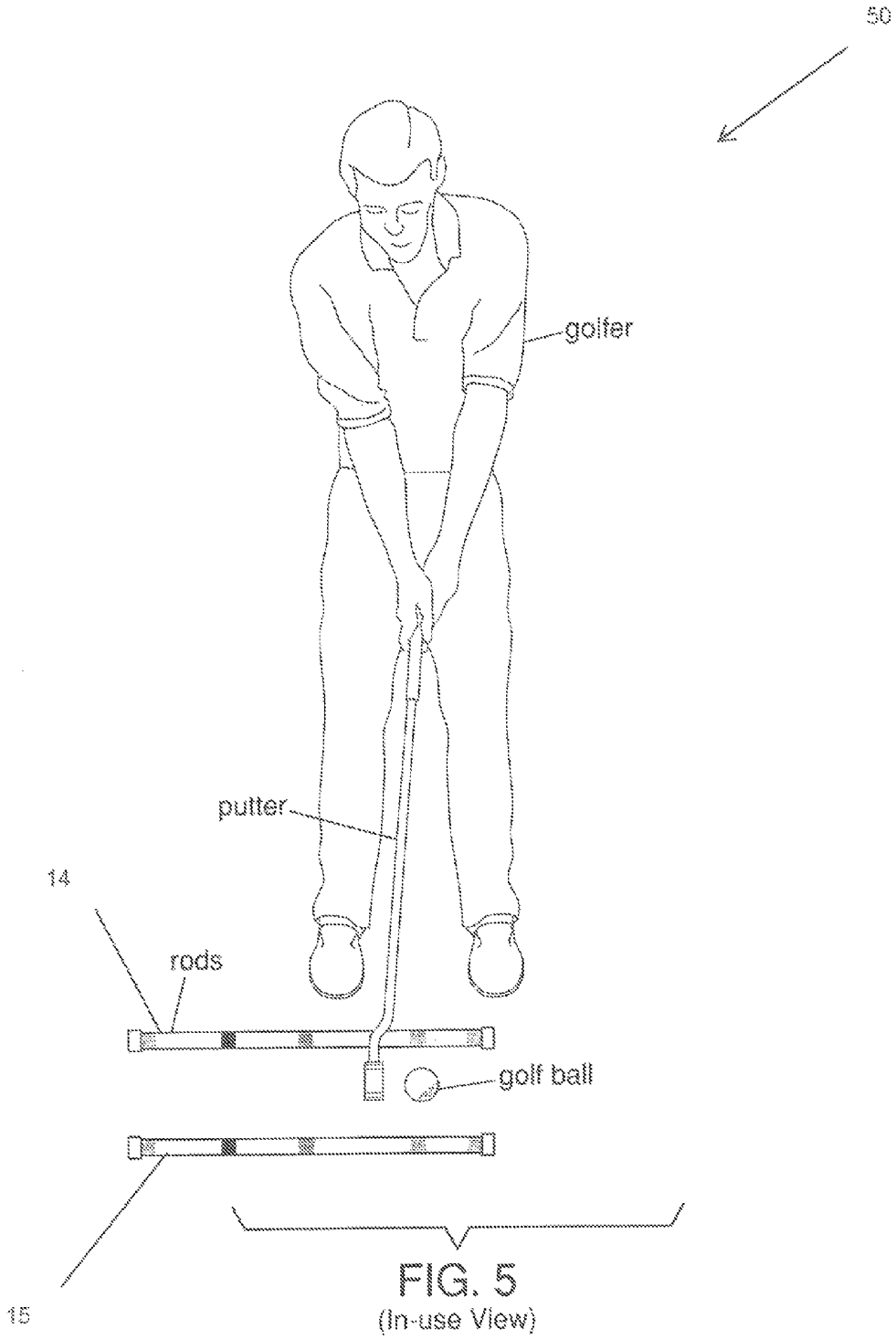
FIG. 5 is an in-use view of the present invention [50].

Referring now to FIGS. 1-5, the present invention features, in some embodiments a portable putting practice system for users of all ages and skill levels, whereby the system enables a user to increase putting accuracy, improve range of motion for a putting swing, and develop consistent putting backswings of varying extensions corresponding to desired target distances.

In some embodiments, the system can comprise a primary elongate rod of a predefined length, [14] said rod comprising: a 1st primary end [12] and a 2nd primary end [13], a primary plurality of fasteners [11], disposed generally at the 1st primary [12] and 2nd primary [13] ends, a first primary colored marker [06] located at a first distance from the second primary end of the rod, a second primary colored marker [07] located at a second distance from the second primary end of the rod, and a third primary colored [08] marker located at a third distance from the second primary end of the rod.

The system can further comprise a separate complimentary elongate rod [15], not connected to the primary elongate rod [14], wherein the complementary elongate rod [15] comprises the same predefined length as the primary elongate rod [14], said complementary elongate rod further comprising: a 1st complementary end [16] and a 2nd complementary end [18], a plurality of complimentary fasteners [17], disposed generally at the 1st complimentary [16] and 2nd complimentary [18] ends, a first complimentary colored marker [26] located the first distance from the 2nd complimentary end of the complimentary rod, a second complimentary colored marker [27] located the second distance from the second complimentary end of the complimentary rod, and third complimentary colored marker [28] located the third distance from the second complimentary end of the complimentary rod.

The portable system can be readily assembled and enabled when a user manually fixes the primary [14] and complimentary [15] elongate rods, in a parallel formation such that the first primary end [12] of the primary elongate rod [14] of a given length and the first complimentary end [16] of the complementary elongate rod [15] of the given length are in alignment, on a putting practice surface, thereby creating a channel, and wherein the channel enables a user to practice putting a golf ball down a straight line and through said channel, and whereby the first [06], second [07] and third [08] primary colored markers of the primary elongate rod [14] and the corresponding first [26], second [27] and third [28] colored complimentary markers of the complementary elongate rod [15] indicate the amount of putting backswing required to strike a golf ball a particular distance corresponding to the colored marker.

The primary and complimentary rods can comprise a wide variety of lengths. While rods of 14 and 27 inches are claimed, it would be appreciated by one skilled in the art that various additional embodiments could comprise rods with wide variations in length and the present invention does not purport to limit the rods to 14 or 27 inches.

As set forth in the claim set, in some embodiments, additional primary and complimentary rods can be added to the system to extend the length of the channel. This additional embodiment can, for example, enable a user to fine tune his/her skills by teaching the user to strike a golf ball down a straight line.

The colored markers claimed and mentioned herein can comprise a variety of different colors and can be located at a variety of positions on the primary and complimentary elongate rods. The colors can correspond to the varying ranges in distances a user desires to strike a golf ball, and the first primary and complimentary colored marker can, in some embodiments, represent the location for placement of a golf ball. For example, the second primary colored marker of the primary elongate rod could be located 5 inches interior from the second primary end of the primary elongate rod, and 2 inches from the first primary colored marker. As such, a user would placed the golf ball adjacent to the first primary colored marker, and use a backswing of 3 inches, extending no further than the second primary colored marker.

In some embodiments, the present invention can be designed to be used by any level of golfer. Beginners and Intermediate level golfers may find that the present invention greatly improves their golf game by vastly cutting down their strokes on the green.

When using the present invention while practicing on the practice range, a user can learn to continuously putt straight while increasing putting accuracy. Any golfer can develop a true firmness of stroke when correctly using the present invention to practice putting.

As used herein, the term "about" refers to plus or minus 10% of the referenced number.

As used herein, the term "about" refers to plus or minus 10% of the referenced number. For example, an embodiment wherein the device is about 10 inches in length includes a device that is between 9 and 11 inches in length.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A portable putting practice system for users of all ages and skill levels, whereby the system enables a user to increase putting accuracy, improve range of motion for a putting swing, and develop consistent putting backswings of varying extensions corresponding to desired target distances, the system comprising:

(a) a cylindrical primary elongate rod of a predefined length, [14] said rod comprising: a 1st primary end [12] and a 2nd primary end [13], a primary plurality of fasteners [11], disposed generally at the 1st primary [12] and 2nd primary [13] ends, a first primary colored marker [06] located at a first distance from the second primary end of the rod, a second primary colored marker [07] located at a second distance from the second primary end of the rod, and a third primary colored [08] marker located at a third distance from the second primary end of the rod, wherein the first primary colored marker [06] is slidably adjustable, wherein the first primary colored marker [06] comprises a unique contrasting color with respect to the primary elongate rod, wherein the second primary colored marker [07] is slidably adjustable, wherein the second primary colored marker [07] comprises a unique contrasting color with respect to the primary elongate rod [14] and the first primary colored marker [06], wherein the third primary colored marker [08] is slidably adjustable, wherein the third primary colored marker [08] comprises a unique contrasting color with respect to the primary elongate rod [14], the first primary colored marker [06], and the second primary colored marker [07]; and (b) a separate cylindrical complimentary elongate rod [15], not connected to the primary elongate rod [14], wherein the complementary elongate rod [15] comprises the same predefined length as the primary elongate rod [14], said complementary elongate rod [15] further comprising: a 1st complementary end [16] and a 2nd complementary end [18], a plurality of complimentary fasteners [17], disposed generally at the 1st complimentary [16] and 2nd complimentary [18] ends, a first complimentary colored marker [26] located the first distance from the 2nd complimentary end of the complimentary rod, a second complimentary colored marker [27] located the second distance from the second complimentary end of the complimentary rod, and third complimentary colored marker [28] located the third distance from the second complimentary end of the complimentary rod, wherein the first complementary colored marker [26] is slidably adjustable, wherein the first complementary colored marker [26] comprises a unique contrasting color with respect to the complementary elongate rod [15], wherein the second complementary colored marker [27] is slidably adjustable, wherein the second complementary colored marker [27] comprises a unique contrasting color with respect to the complementary elongate rod [15] and the first complementary colored marker [26], wherein the third complementary colored marker [28] is slidably adjustable, wherein the third complementary colored marker [28] comprises a unique contrasting color with respect to the complementary elongate rod [15], the first complementary colored marker [26], and the second complementary colored marker [27];

wherein the portable system is readily assembled and enabled when a user manually fixes the primary [14] and complimentary [15] elongate rods, in a parallel formation such that the first primary end [12] of the primary elongate rod [14] of a given length and the first complimentary end [16] of the complementary elongate rod [15] of the given length are in alignment, on a putting practice surface, thereby creating a channel, and wherein the channel enables a user to practice putting a golf ball down a straight line and through said channel, and whereby the first [06], second [07] and third [08] primary colored markers of the primary elongate rod [14] and the corresponding first [26], second [27] and third [28] colored complimentary markers of the complementary elongate rod [15] indicate the amount of putting backswing required to strike a golf ball a particular distance corresponding to the colored marker.

2. The plurality of primary fasteners [11] of claim 1, whereby the primary fasteners [11] comprise a plurality of spikes, perpendicularly fixed to the primary elongate rod [14] which allow a user to easily fix to and remove the primary elongate rod [14] from a putting practice surface.

3. The plurality of complimentary fasteners [17] of claim 1, whereby the complimentary fasteners [17] comprise a plurality of spikes, perpendicularly fixed to the complimentary elongate rod [15] which allow a user to easily fix to and remove the complimentary elongate rod [15] from a putting practice surface.

4. The 1st [12] and 2nd [13] primary ends of claim 1, wherein said primary ends further comprise a rubber tip affixed to and covering both the 1st [12] and 2nd [13] primary ends.

5. The 1st [16] and 2nd [18] complementary ends of claim 1, wherein said complimentary ends further comprise a rubber tip affixed to and covering both the 1st [16] and 2nd [18] complementary ends.

6. The primary elongate rod [14] of claim 1, wherein the primary elongate rod [14] is made from metal.

7. The complementary elongate rod [15] of claim 1, wherein the complementary elongate rod [15] is made from metal.

8. The primary [14] and complementary [15] rods of claim 1, wherein the primary [14] and complementary [15] rods are 27 inches in length.

9. The primary [4] and complementary [15] rods of claim 1, wherein the primary [14] and complementary [15] rods are 14 inches in length.

10. The system of claim 1, wherein the first primary colored marker [06] and the first complementary colored marker [26] indicates the position for the user to place a golf ball.

11. The system of claim 1, wherein the primary [14] and complementary [15] elongate rods form a parallel channel which ranges from 2-10 inches in width.

12. The system of claim 1, wherein the system further comprises additional primary colored markers on the primary elongate rod [14] within a range of 4-10 markers.

13. The system of claim 1, wherein the system further comprises additional complimentary colored markers on the complimentary elongate rod [15] within a range of 4-10 markers.

14. The system of claim 1, the system further comprising a second primary elongate rod and a second complementary elongate rod, wherein the user extends the channel of claim 1 by placing a 1st end of the second primary rod in substantial linear alignment with the 2nd end [13] of the primary elongate rod [14] of claim 1, and by placing a 1st end of the second complimentary rod in substantial linear alignment with the 2nd end [18] of the complimentary elongate rod [15] of claim 1.

15. A portable putting practice system for users of all ages and skill levels, whereby the system enables a user to increase putting accuracy, improve range of motion for a putting swing, and develop consistent putting backswings of varying extensions corresponding to desired target distances, the system consisting of:

(a) a cylindrical primary elongate rod of a predefined length, [14] said rod consisting of a 1st primary end [12] and a 2nd primary end [13], a primary plurality of fasteners [11], disposed generally at the 1st primary [12] and 2nd primary [13] ends, a first primary colored marker [06] located at a first distance from the second primary end of the rod, a second primary colored marker [07] located at a second distance from the second primary end of the rod, and a third primary colored [08] marker located at a third distance from the second primary end of the rod, wherein the first primary colored marker [06] is slidably adjustable, wherein the first primary colored marker [06] consists of a unique contrasting color with respect to the primary elongate rod, wherein the second primary colored marker [07] is slidably adjustable, wherein the second primary colored marker [07] consists of a unique contrasting color with respect to the primary elongate rod [14] and the first primary colored marker [06], wherein the third primary colored marker [08] is slidably adjustable, wherein the third primary colored marker [08] consists of a unique contrasting color with respect to the primary elongate rod [14], the first primary colored marker [06], and the second primary colored marker [07]; and (b) a separate cylindrical complimentary elongate rod [15], not connected to the primary elongate rod [14], wherein the complementary elongate rod [15] consists of the same predefined length as the primary elongate rod [14], said complementary elongate rod [15] further consists of: a 1st complementary end [16] and a 2nd complementary end [18], a plurality of complimentary fasteners [17], disposed generally at the 1st complimentary [16] and 2nd complimentary [18] ends a first complimentary colored marker [26] located the first distance from the 2nd complimentary end of the complimentary rod, a second complimentary colored marker [27] located the second distance from the second complimentary end of the complimentary rod, and third complimentary colored marker [28] located the third distance from the second complimentary end of the complimentary rod, wherein the first complementary colored marker [26] is slidably adjustable, wherein the first complementary colored marker [26] consists of a unique contrasting color with respect to the complementary elongate rod [15], wherein the second complementary colored marker [27] is slidably adjustable, wherein the second complementary colored marker [27] consists of a unique contrasting color with respect to the complementary elongate rod [15] and the first complementary colored marker [26], wherein the third complementary colored marker [28] is slidably adjustable, wherein the third complementary colored marker [28] consists of a unique contrasting color with respect to the complementary elongate rod [15], the first complementary colored marker [26], and the second complementary colored marker [27];

wherein the portable system is readily assembled and enabled when a user manually fixes the primary [14] and complimentary [15] elongate rods, in a parallel formation such that the first primary end [12] of the primary elongate rod [14] of a given length and the first complimentary end [16] of the complementary elongate rod [15] of the given length are in alignment, on a putting practice surface, thereby creating a channel, and wherein the channel enables a user to practice putting a golf ball down a straight line and through said channel, and whereby the first [06], second [07] and third [08] primary colored markers of the primary elongate rod [14] and the corresponding first [26], second [27] and third [28] colored complimentary markers of the complementary elongate rod [15] indicate the amount of putting backswing required to strike a golf ball a particular distance corresponding to the colored marker.

* * * * *